US007587151B2

(12) United States Patent
Hanada et al.

(10) Patent No.: US 7,587,151 B2
(45) Date of Patent: Sep. 8, 2009

(54) IMAGE FORMING APPARATUS WHICH EXCUTES CHECK MODE PRIOR TO ORDINARY IMAGE FORMATION

(75) Inventors: Takako Hanada, Yokohama (JP); Naoto Watanabe, Kashiwa (JP); Kuniyasu Kimura, Toride (JP); Hiroto Nishihara, Toride (JP); Yukio Yokoyama, Sakado (JP)

(73) Assignee: Canon Kabushiki Kaisha, Tokyo (JP)

( * ) Notice: Subject to any disclaimer, the term of this patent is extended or adjusted under 35 U.S.C. 154(b) by 326 days.

(21) Appl. No.: 11/355,103

(22) Filed: Feb. 16, 2006

(65) Prior Publication Data

US 2007/0147865 A1 Jun. 28, 2007

(30) Foreign Application Priority Data

Mar. 8, 2005 (JP) ..... 2005-064231

(51) Int. Cl.
*G03G 15/20* (2006.01)
*G03G 15/00* (2006.01)

(52) U.S. Cl. ..... 399/67; 399/15

(58) Field of Classification Search ..... 399/15, 399/67

See application file for complete search history.

(56) References Cited

U.S. PATENT DOCUMENTS

| | | | | |
|---|---|---|---|---|
| 5,436,711 | A | 7/1995 | Hauser | 355/290 |
| 2003/0007814 | A1 * | 1/2003 | Richards | 399/341 |
| 2003/0180074 | A1 | 9/2003 | Noya et al. | 399/328 |
| 2004/0257601 | A1 | 12/2004 | Tomiyasu et al. | 358/1.9 |
| 2005/0135823 | A1 * | 6/2005 | Ng | 399/49 |
| 2005/0206064 | A1 | 9/2005 | Moriyama et al. | 270/58.08 |
| 2006/0115288 | A1 * | 6/2006 | Roof | 399/67 |
| 2006/0227205 | A1 | 10/2006 | Nishihara et al. | 347/194 |

FOREIGN PATENT DOCUMENTS

| | | |
|---|---|---|
| EP | 1 582 940 | 10/2005 |
| EP | 1 582 940 A2 | 10/2005 |
| JP | 2000-221821 | 8/2000 |
| JP | 2003-167459 | 6/2003 |

OTHER PUBLICATIONS

Official Letter/Search Report, issued by the European Patent Office, on Dec. 28, 2007, in Application No. 06 110 770.2.

* cited by examiner

*Primary Examiner*—David M Gray
*Assistant Examiner*—Joseph S Wong
(74) *Attorney, Agent, or Firm*—Fitzpatrick, Cella, Harper & Scinto

(57) ABSTRACT

An image forming apparatus capable of obtaining an image of a desired quality by a simple method is provided with an image forming device for forming a toner image on a recording material, a plurality of pairs of fixing rollers provided to fix the toner image, a glossiness detecting sensor for detecting the state of the image on the recording material on which the toner image has been fixed, and a controller for controlling the fixing conditions of the plurality of pairs of fixing rollers, and has a first image check mode for fixing the toner image by one pair of fixing rollers of the plurality of pairs of fixing rollers, and a second image check mode for fixing the toner image by the plurality of pairs of fixing rollers, and the controller selects whether the second image check mode should be executed, on the basis of the result of the glossiness detecting sensor having detected the state of the image on the recording material on which the formed image has been fixed by the first image check mode.

2 Claims, 4 Drawing Sheets

IMAGE FORMING APPARATUS WHICH EXCUTES CHECK MODE PRIOR TO ORDINARY IMAGE FORMATION

BACKGROUND OF THE INVENTION

1. Field of the Invention

The invention relates to an image forming apparatus using an electrophotographic printing method or an electrostatic recording method, and particularly to an image forming apparatus such as a copying machine, a printer or a facsimile apparatus.

2. Description of Related Art

In image forming apparatus such as a printing machine, a copying machine and a printer, image outputs higher in quality of image have come to be required. As a guide to the high quality of image, there is the glossiness of a printed image. Particularly in the case of an image such as a photograph or an illustration, there is the tendency that an image of high glossiness is liked.

What determines the glossiness of an image is the fixing time or the fixing temperature in a fixing apparatus for fixing an unfixed toner image on a sheet such as paper or OHP film, i.e., the amount of heat applied to the sheet during fixing. By the amount of heat applied to the sheet during fixing, the fused state of a toner or the permeability of the toner into the sheet is changed, whereby the gloss of the image is changed. Usually, the greater becomes the amount of applied heat, the higher becomes the gloss of the image.

So, in order to realize the glossiness desired by a user, there has been devised an image forming apparatus provided with a plurality of fixing devices.

In Japanese Patent Application Laid-open No. 2003-167459 and Japanese Patent Application Laid-open No. 2000-221821, it is described to effect image forming by the use of a plurality of fixing. apparatuses. Design is made such that of the plurality of fixing apparatuses, the number of fixing apparatuses to be used is automatically switched depending on such conditions as the kind of the paper selected by the user, and whether the copy image is monochromatic or multicolored.

Particularly, in Japanese Patent Application Laid-open No. 2000-221821, there are disclosed two kinds of constructions, i.e., (i) a case where the user sets glossiness, and (ii) glossiness is automatically determined by the material of a sheet. In the case (i), even if the set gloss mode is high gloss, when the glossiness of a sheet itself is low, the outputted image is merely of the high gloss when that sheet is used. Therefore, it differs from the actually desired glossiness of the output image. In the case (ii), the glossiness is primarily determined by the material or basis weight of the sheet and therefore, it may also differ from the glossiness of the output image actually desired by the user.

If the output image of glossiness differing from the glossiness desired by the user, as described above, is intactly printed in a number of copies, there will result a great deal of products low in degree of satisfaction. That is, in the conventional construction, wasteful prints are outputted, and an improvement in usability is demanded.

SUMMARY OF THE INVENTION

It is an object of the present invention to provide an image forming apparatus, which can improve usability.

It is another object of the present invention to provide an image forming apparatus, which can form an image high in degree of satisfaction.

It is another object of the present invention to provide an image forming apparatus comprising an image forming device, which forms an image on a recording material, a first image heating device, which heats the image on the recording material, and a second image heating device, which heats the image on the recording material heated by the first image heating device, wherein the image forming apparatus is operable in a first check mode for checking up the image heated by the use of only the first image heating device, and in a second check mode for checking up the image heated by the use of the first image heating device and the second image heating device.

It is also an object of the present invention to provide an image forming apparatus comprising an image forming device, which forms an image on a recording material, and a plurality of image heating devices, which heat the image on the recording material, wherein the image forming apparatus is operable in a plurality of image checking modes corresponding to a plurality of ordinary image forming modes differing in an image heating device used for image heating from one another.

Further objects of the present invention will become apparent from the following detailed description when read with reference to the accompanying drawings.

DETAILED DESCRIPTION OF THE PREFERRED EMBODIMENTS

The best aspect for carrying out this invention will herein after be described in detail by way of example with reference to the drawings. However, the function, dimensions, materials, shapes and relative disposition of constituent parts described in this embodiment, unless particularly described, are not intended to restrict the scope of this invention thereto. Also, the function, material, shape, etc. of a member once described in the following description, unless newly described, are similar to those described at first.

Embodiment 1

(Schematic Construction of the Image Forming Apparatus)

Figure 1:
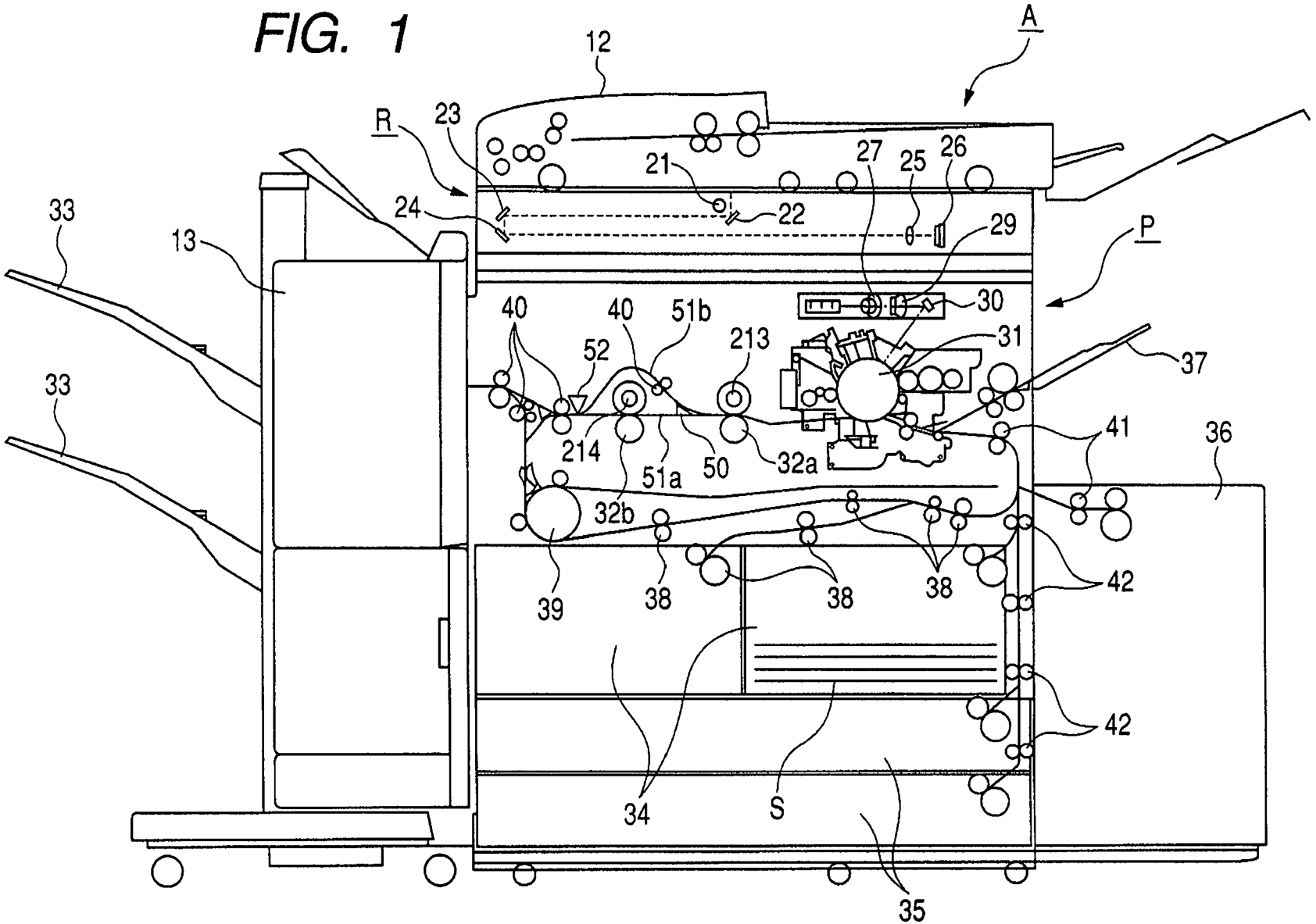
FIG. 1 schematically shows the construction of an image forming apparatus according to an embodiment of the present invention.

FIG. 1 is a cross-sectional view of an image forming apparatus to which the present invention can be suitably applied. While in the present embodiment, an image forming apparatus of a monochromatic type having a single developing device will be described as an example, the image forming apparatus according to the present invention is not restricted thereto, but may be an image forming apparatus of a color type having a plurality of developing devices.

The image forming apparatus A is provided with an image inputting portion R for reading image data from an original, an image forming portion P for forming the image of the original on a sheet-like recording material such as paper or an OHP sheet and outputting the recording material, an automatic original feeding apparatus (hereinafter referred to as the feeder) F mounted on the upper portion of the image inputting portion R, and a sorter 13 for sorting recording materials discharged from the image forming portion P into a plurality of bins and discharging the recording materials.

The image forming apparatus A according to the present embodiment is a digital copying machine, and the original is made into pixels by the CCD of the image inputting portion R and is read into the apparatus as image data. The thus read image data is subjected to necessary image processing, and thereafter is stored in an image memory. The image data is forwarded to the image forming portion P, and the image is reproduced, whereby the image of the original is copied on the recording material.

The image inputting portion R is provided with a light source 21 for irradiating and scanning the originals stacked on an original plate on the upper surface of the inputting portion. The light source 21 obtains a driving force from an optical system motor (not shown) and is reciprocally driven in the left to right direction as viewed in FIG. 1. Light emitted from the light source 21 is reflected by the stacked originals, and an optical image is obtained. The optical image is transmitted to a CCD 26 through the intermediary of mirrors 22, 23, 24 and a lens 25. Also, the mirrors 22, 23 and 24 are driven integrally with the light source 21.

The CCD 26 is constituted by an element for converting light into an electrical signal, and by the work of this element, the optical image transmitted thereto is converted into an electrical signal, and is further converted into a digital signal (image data).

The image data of the read original is subjected to various correcting processes and image processing by processing desired by the user and is accumulated in the image memory (not shown).

The image forming portion P reads out the image data accumulated in the image memory, and reconverts the read-out image data from the digital signal into an analog signal. The analog signal is further amplified to a proper output value by an exposure controlling portion (not shown), and is converted into an optical signal by an optical irradiating portion 27.

The converted optical signal is propagated through a scanner 28, a lens 29 and a mirror 30, and is applied onto a photosensitive drum 31, and an electrostatic latent image is formed thereon. This electrostatic latent image is developed as a toner image with a toner (developer). Then, the toner image is transferred, and a toner image is formed on a recording material conveyed in an image forming apparatus main body. Further, the toner image is fixed on the recording material by a pair of fixing rollers 32*a*. In the present embodiment, as a plurality of fixing means, a pair of fixing rollers 32*b* is provided besides the pair of fixing rollers 32*a*.

Here, a fixing flapper 50 is driven by a job (image data/material/condition setting) to thereby selectively convey the recording material to a conveying path 51*a* passing the pair of fixing rollers 32*b* or a conveying path 51*b* not passing the pair of fixing rollers 32*b*.

The recording material conveyed to the conveying path 51*a* is in a state in which it has already passed the pair of fixing rollers 32*a* and the toner image thereon has been fixed and therefore, by passing the pair of fixing rollers 32*b*, the recording material can realize the securement of a stable fixing property and desired glossiness, irrespective of the material and thickness of the recording material, and the image data. The recording material S having passed the pairs of fixing rollers 32*a* and 32*b* is conveyed to the sorter 13.

The sorter 13 is an apparatus installed on the left side of the image forming portion P, and carries out the process of sorting and discharging the recording material S outputted from the image forming portion P to a discharging tray 33. The discharging tray 33 is controlled by a main body controlling portion (not shown), and the outputted recording material S is discharged to any discharging tray designated by the main body controlling portion.

Feeding trays 34 and 35 are provided in the lower portion of the main body, and can contain the recording materials S therein to a certain extent. The recording materials S contained in the feeding trays 34 and 35 are conveyed therefrom by the main body controlling portion, and image outputting is performed.

A feeding deck 36 is an apparatus installed on the right side of the image forming portion P, and can contain the recording materials S therein in a great deal. The feeding deck 36, like the feeding trays 34 and 35, conveys the recording materials S contained therein by the main body controlling portion and performs image outputting.

A manually feeding tray 37 is installed on the right side of the image forming portion P, and enables an operator to feed a few arbitrary kinds of recording materials relatively easily. Also, the manually feeding tray 37 is used when use is made of special recording materials such as OHP sheets, thick paper and postcard size paper.

Feeding rollers 38, 39, 40, 41 and 42 are conveying rollers for conveying the recording material, and each of these rollers performs the role of actually conveying the recording material S when performing the sheet feeding for a copy outputting process. Each feeding roller is connected to a stepping motor as an independent drive source through a transmission device such as a gear.

The rotating speed of the photosensitive drum 31 and the pairs of fixing rollers 32*a* and 32*b* controlled by a DC brushless motor is called a process speed, and is set on the basis of the shape and fixing characteristic of the toner, and the light emitting characteristic of the laser.

The pairs of fixing rollers 32*a* and 32*b* are heated by fixing heaters 213 and 214, respectively. Also, the surface temperatures of the pairs of fixing rollers 32*a* and 32*b* are detected by thermistors 202 and 204, respectively, whereby the surface temperatures of the pairs of fixing rollers 32*a* and 32*b* are controlled so as to assume predetermined values, respectively.

(Block Diagram of the Controlling Portion)

Figure 2:
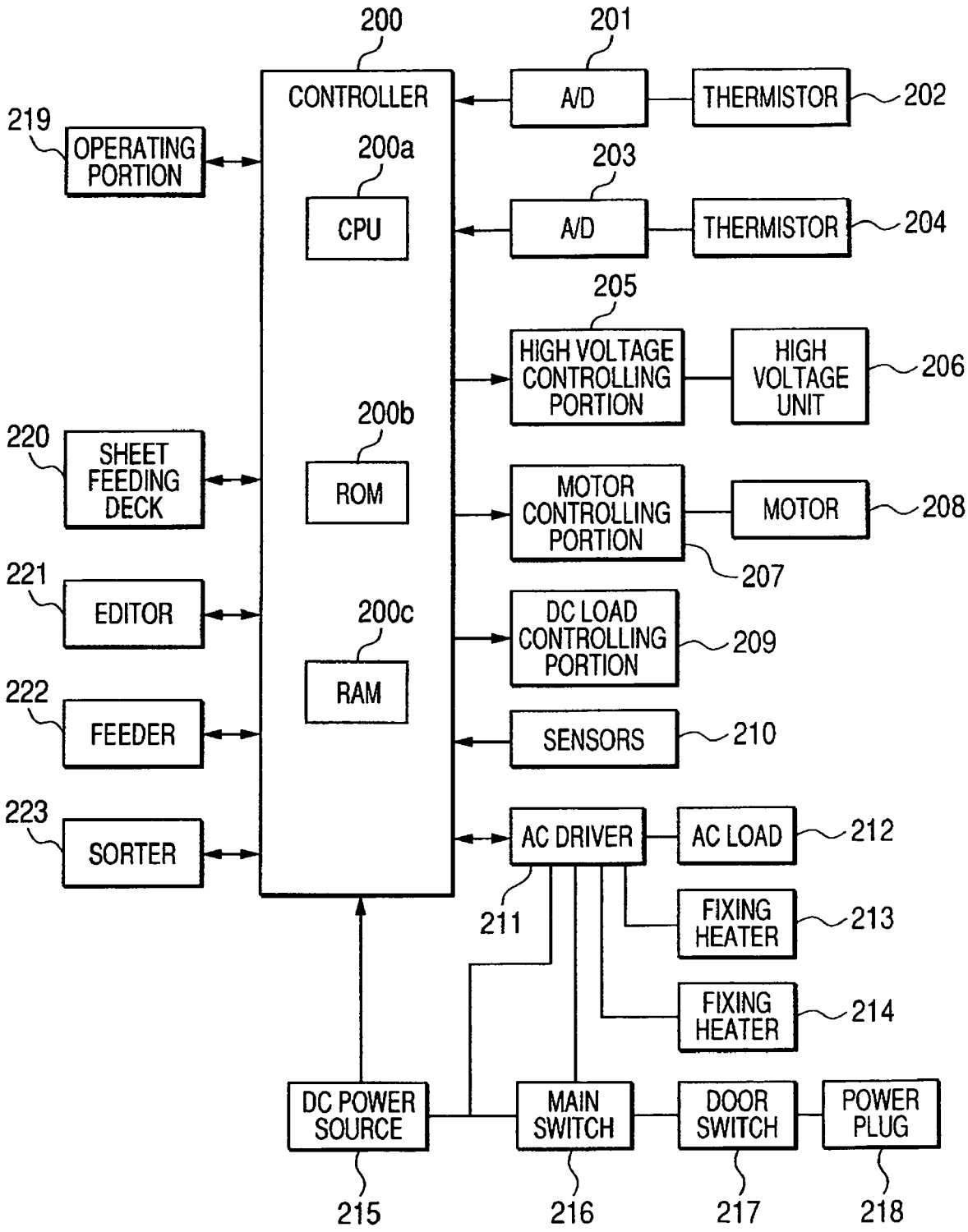
FIG. 2 is a block diagram of a control system according to an embodiment of the present invention.

FIG. 2 is a block diagram showing an example of the controlling portion of the image forming apparatus according to the present embodiment. In FIG. 2, controlling means (controller) 200 is comprised of a CPU 200*a*, a ROM 200*b*, a RAM 200*c*, etc., and controls a copying sequence on the basis of a program stored in the ROM 200*b*. It also controls the fixing condition of the plurality of fixing means.

In an operating portion 219 as a setting device (a designating device), there are disposed a key input portion including a copying mode setting key, a copy number setting key, a copying operation starting key, a copying operation stopping key, a reset key for returning an operating mode to a standard state, etc., and a display portion such as an LED and liquid crystal for displaying the set state of the operating mode, etc.

A thermister 202 as first detecting means detects a signal value corresponding to the surface temperature of the pair of fixing rollers 32*a* as a first image heating device (first fixing means). The detected signal value is A/D-converted by an A/D converter 201, and the value is inputted to the controller 200. The controller 200 controls the supply of electric power to a fixing heater 213 on the basis of the signal value detected by the thermister 202 so that the surface temperature of the pair of fixing rollers 32*a* may assume a predetermined value.

Likewise, a thermister 204 as second detecting means detects a signal value corresponding to the surface temperatures of the pair of fixing rollers 32*b* as a second image heating device (second fixing means). The detected signal value is A/D-converted by an A/D converter 203, and the value is inputted to the controller 200. The controller 200 controls the supply of electric power to a fixing heater 214 on the basis of the signal value detected by the thermister 204 so that the surface temperature of the pair of fixing rollers 32*b* may assume a predetermined value.

At this time, the predetermined value of the surface temperature (hereinafter referred to as the set temperature) of the pair of fixing rollers 32*a* is set to a temperature necessary to heat and pressurize the toner on the recording material to thereby fix the toner image. On the other hand, the pair of fixing rollers 32*b* are used to improve the glossiness of the toner image and therefore, in the present embodiment, they are set to a set temperature lower than the set temperature of the pair of fixing rollers 32*a* which performs the present fixing. Specifically, in the present embodiment, the set temperature of the pair of fixing rollers 32*a* is 200 degrees, and the set temperature of the pair of fixing rollers 32*b* is 185 degrees. Of course, the set temperatures of the pairs of fixing rollers 32*a* and 32*b* are not restricted to such examples, but can be set with various conditions taken into account. Also, in the present embodiment, the pressure forces of the pair of fixing rollers 32*a* and the pair of fixing rollers 32*b* are set to substantially the same pressure force, but may be set to different pressure forces with various conditions taken into account.

A high voltage controlling portion 205 performs the control of a high voltage unit 206 for applying predetermined electric potential to charging members such as a primary charger and a transfer charger, and a developing apparatus or the like.

A motor controlling portion 207 controls the driving of motors 208 such as various stepping motors.

A DC load controlling portion 209 controls the driving of the solenoid of the fixing flapper 50, the photosensitive drum 31, the pairs of fixing rollers 32*a* and 32*b* and a fan or the like.

Sensors 210 are sensors for detecting the paper dogging or the like of the recording paper, and output the detected signals to the controller 200.

An AC driver 211 controls the supply of AC electric power to an AC load 212 such as the light source 21, and the fixing heaters 213 and 214. Also, it detects the abnormality of the light source 21, the fixing heaters 213 and 214, etc. and renders a main switch 216 with a shutting-off function into an off state.

A DC power source 215 supplies DC electric power to the controller 200, etc. Also, AC electric power inputted from a power plug 218 is inputted to the DC power source 215 through a door switch 217 and a main switch 216.

A feeding deck 220 is an apparatus for increasing the number of stacked recording materials, an editor 221 inputs positional information such as trimming and masking processes, a feeder 222 automatically sets a plurality of originals, and a sorter 223 sorts the discharged recording materials, and these are not requisite for the image forming apparatus, but are optionally connected.

Figure 3:
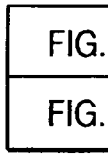
FIG. 3 is comprised of FIGS. 3A and 3B are flow charts showing an image forming operation.
Figure 3A:
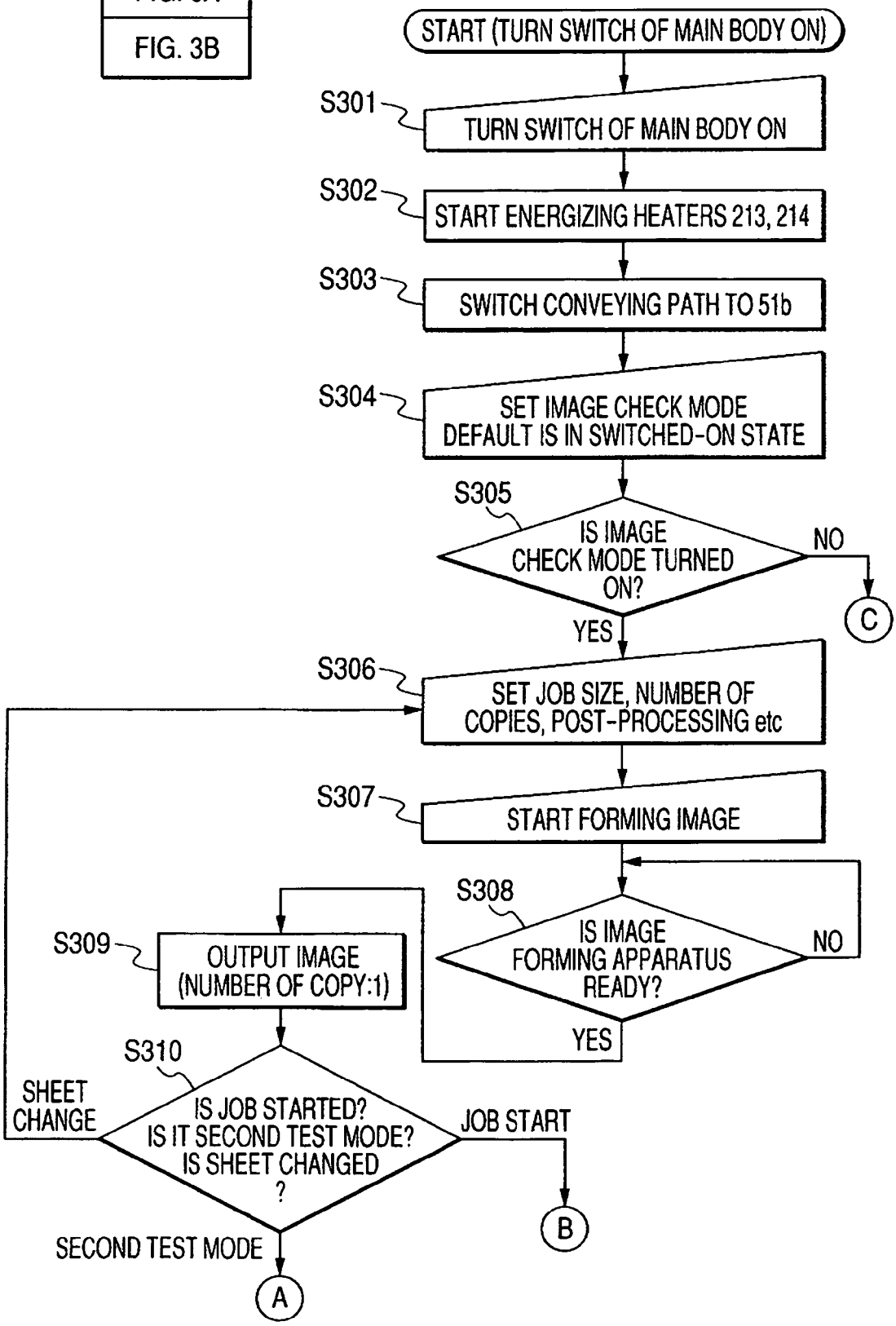
Figure 3B:
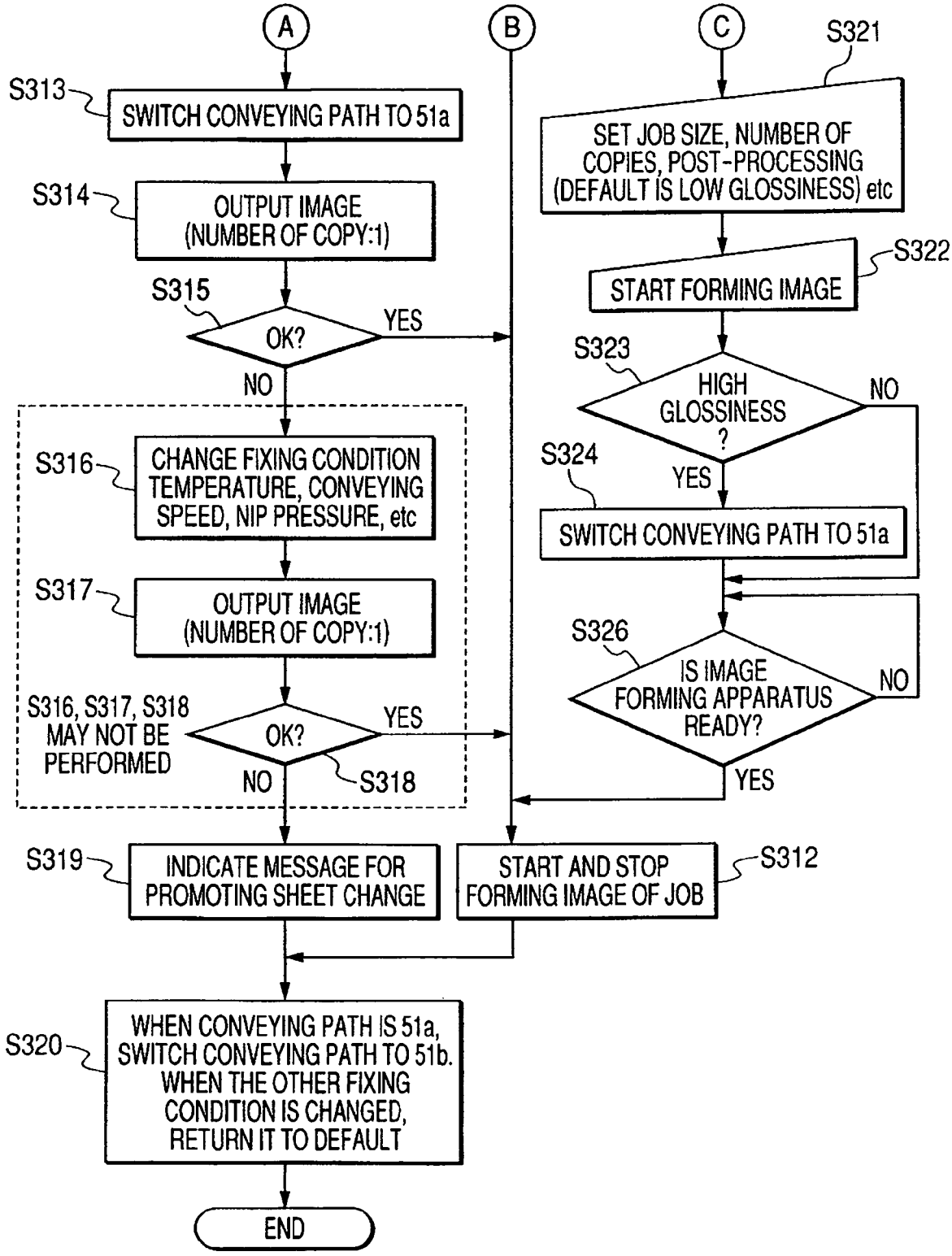

The control of the above-described image forming apparatus will now be described. FIGS. 3A and 3B are flow charts in case of image formation.

The present embodiment has a first image forming mode in which the toner image is fixed by one of the plurality of fixing means, and a second image forming mode in which the toner image is fixed by two or more of the plurality of fixing means. Specifically, it has the first image forming mode (low gloss mode) in which a fixing process (image heating process) is carried out by only the pair of fixing rollers 32*a*, and the second image forming mode (high gloss mode) in which a fixing process (image heating process) is carried out by the pair of fixing rollers 32*a* and the pair of fixing rollers 32*b*.

Also, the present embodiment has a first image check mode and a second image check mode correspondingly to the above-described plurality of ordinary image forming modes. Specifically, it has an image check mode for checking up the image subjected to the fixing process by only the pair of fixing rollers 32*a*, and an image check mode for checking up the image subjected to the fixing process by the pair of fixing rollers 32*a* and the pair of fixing rollers 32*b*. These image check modes are for the user to check up the glossiness of the image.

When the main switch of the image forming apparatus main body is turned on (S301), the controller 200 starts the supply of electric power to the fixing heater 213 in the pair of fixing rollers 32*a* and the fixing heater 214 in the pair of fixing rollers 32*b* through an AC driver 211 (S302).

At this time, the CPU 200*a* A/D converts signal values detected by the thermistors 202 and 204 attached to the fixing heaters 213 and 214, respectively by the A/D converters 201 and 203, and performs control such as phase control on the basis of the values, and controls the temperatures of the fixing heaters 213 and 214 so as to become their respective set temperatures. Thereafter, the fixing flapper 50 is switched so that the conveying path 51*b* for conveying the recording material in the first image forming mode (first image check mode) may be selected (S303), and an input from the copying operation setting key of the operating portion 219 is waited for. Here, the conveying path 51*b* is a path which does not pass the pair of fixing rollers 32*b* used only in the second image forming mode (second image check mode) which will be described later.

Next, the setting of the image check modes is performed. In the present embodiment, design is made such that when starting an ordinary image forming job, whether at least one of the first image check mode and the second image check mode should be inserted can be selected.

In the present embodiment, when neither of the first image check mode and the second image check mode is used, setting is performed from the operating portion 219 and the operation of the image check modes is prohibited (S304). The setting of default is designed such that the image check modes are operated. Also, the setting of the image check modes may be performed at any timing if before the image forming operation (S307).

Next, whether the image check mode is turned on is judged (S305). If the image check mode is turned on, the setting of a copy job or a print job is performed. What are set here are the size of the sheet (recording material) on which an image is formed, the number of copies (the number of image-formed sheets), the presence or absence of post-processing, etc. (S306). When information necessary for the job has been completely inputted, an image forming command is outputted (a copy start key is depressed), and image forming is started (S307).

The image forming portion P which has received the image forming command, in a state in which the fixing heaters 213 and 214 of the image forming apparatus have sufficiently risen in temperature and image forming is possible (S308), outputs a sheet on which an image has been formed (S309). This is a recording material outputted by the first image check mode. Here, the controller once stops image outputting, and comes to wait for image check-up by the user.

Specifically, the recording material on which an unfixed toner image is formed is fixed by the pair of fixing rollers 32*a*, passes the fixing flapper 50, and does not pass the pair of fixing rollers 32*b* in the conveying path 51*b*, but is discharged out of the machine by the conveying rollers 40.

The user checks up this image, and when it is judged by the user's own visual perception or on the basis of the result of the user having measured the output image by a measuring apparatus that the glossiness of the image is appropriate, the user depresses the copy start key in the operating portion 219, whereby instructions to select the job start (the operation by the ordinary image forming mode) are outputted (S310).

The controller 200 judges that the glossiness desired by the user can be provided without the use of the pair of fixing rollers 32*b*, and carries out the image forming process for the number of copies set by the user minus one copy in the conveying path 51*b* (S312), thus completing the image forming operation.

In this case, the recording materials outputted in the first image check mode are handled as a part of the ordinary image forming job thereafter and therefore, a useless output can be reduced as compared with a construction in which a special image pattern is prepared for use in the image check mode.

Design is made such that at S310, on the operating portion 219, the display (report) of "Do you start the job with this test image? Or do you execute the second image check mode?" etc. is performed as the confirmation of the execution of the second image check mode.

On the other hand, if at S310 in the first image check mode, the user judges that the glossiness of the output image is not sufficient and the second pair of fixing rollers 32*b* also need be used, the user inputs and sets the information from the operating portion 219. Then, the controller 200 switches the fixing flapper 50 as switching means in conformity with the set information to thereby switch the conveying path of the recording material to 51*a* (S313).

Thus, the controller 200 enables whether the second image check mode should be executed after the execution of the first image check mode to be selected.

Then, an image to be outputted again is outputted on a recording material discrete from the recording material used in the aforedescribed image check mode (the same kind as the previously used recording material) (S314). This is the recording material outputted by the second image check mode.

Specifically, the unfixed toner image formed on the recording material S is fixed by the pair of fixing rollers 32*a*. Then, the recording material S passes the fixing flapper 50, and is again heated by the pair of-fixing rollers 32*b* in the conveying path 51*a*, and thereafter is discharged out of the apparatus by the conveying rollers 40.

The user checks up this image, and judges whether the glossiness thereof is appropriate (S315). Also, with the completion of the check-up of the glossiness of the image, a report for the confirmation of the start of the execution of the ordinary image forming job is performed.

Here, if the user judges that the glossiness of the image is satisfactory, when the instructions of OK is outputted from the copy start key in the operating portion 219, an image forming process for the number of copies set by the user minus one copy is carried out in the conveying path 51*a* by the use of the pair of fixing rollers 32*b* (S312).

When there after, the image forming process for the set number of copies is completed, the conveying path is switched to 51*b*, thus completing the operation of the image forming apparatus main body (S320).

If at that time, the fixing condition has been changed, the fixing condition is reset to standard fixing conditions, where after the operation of the apparatus main body is completed.

According to the above-described control, the image output by the first image check mode is only one copy and therefore, in the case of a job for printing a plurality of copies, shift can be made to the second image check mode before all the number of copies are printed and thus, useless print can be reduced.

On the other hand, the image forming apparatus may preferably be designed such that if at S315, it is judged that the glossiness is insufficient, the user can perform further setting to thereby change the fixing conditions such as the fixing temperature, the conveying speed and the fixing pressure. In such a case, the user is called upon to change those fixing conditions so that appropriate glossiness may be provided (S316), and after the fixing conditions have been changed, an image prepared again is outputted on a sheet (S317). Specifically, a key for making the set temperature of the pair of fixing rollers 32*b* high or low is prepared in the operating portion and therefore, if it is desired to make the glossiness of the image higher, the user depresses a key for "making the set temperature high". On the other hand, if it is desired to make the glossiness of the image low (higher than the glossiness of the image in the first image forming mode), the user depresses a key for "making the set temperature low". The names of the keys displayed on the operating portion need not always be the high-low of the set temperature as described above, but may be the high-low of the glossiness.

The user checks up this image and judges whether the glossiness thereof is appropriate (S318). Here, if it is judged by the user that the glossiness of the image is satisfactory, when the instructions of OK is outputted from the copy start key in the operating portion 219, an image forming process for the number of copies set by the user minus one copy is carried out under the set fixing conditions (S312), and the fixing conditions changed at S316 are reset to the standard fixing conditions, whereafter the operation of the apparatus main body is completed (S320).

If at S318, it is judged that the glossiness is not yet appropriate, the controller 200 judges that the glossiness desired by the user cannot be obtained on the set paper, and displays on the operating portion a message calling upon the user to change the paper such as "Any higher glossiness cannot be obtained on this paper. Please change the paper and execute again." (S319), thus completing the image forming operation. S316 to S318 may be omitted in some cases, and if at S315, it is judged that the desired glossiness cannot be obtained, display for calling upon the user to change the paper may be intactly performed at S319.

Thus, in the present embodiment, the toner image is fixed on the recording material by the execution of the first image check mode and the second image check mode and the recording material is outputted, whereafter whether an image forming operation (ordinary image forming) based on the thitherto set conditions of the image forming job should be executed or stopped can be selected.

As the result, as compared with a case where the image forming operation for a plurality of copies based on the set conditions of the image forming job is executed without the use of the image check modes, an image low in the degree of satisfaction to the user (in the present embodiment, the glossiness of the image) can be prevented from being outputted. That is, if a desired image state is not obtained under the initially set conditions, any further image forming operation is stopped and the fixing conditions of the fixing means are changed, whereby there can be obtained a recording material which is in a desired image state, and the outputting of a useless recording material can be omitted and a reduction in cost can be achieved.

There is also supposed a case where at S310, the user looks at the recording material outputted by the first image check mode and desires to change the paper or change the fixing conditions without shifting to the second image check mode. So, if it is judged that it is evident that by the paper used in the first image check mode, desired glossiness cannot be obtained even if the plurality of fixing means are used (S310), return is made to S306, where the changing of the setting such as changing the paper used (e.g. changing from plain paper to glossy paper) may be performed so that image check-up may be again started from the first image check mode.

Depending on the user, there is a case where the setting of the glossiness is felt to be cumbersome, or a case where the correlation between the glossiness and the image is already known and test print (automatic execution of the image check mode) is unnecessary. There is also a user who does not like that a trial print image is outputted each time image forming is performed. In that case, at S304, an OFF key for the image check mode may be prepared in the operating portion, and design may be made such that the user depresses this key, whereby the image check mode automatically executed in operative association with ordinary image forming is turned off. Thereupon, in case of the setting of the conditions of the image forming job, the glossiness can be set (S321), but if the glossiness is not particularly minded, if nothing is set here, the glossiness becomes "low gloss" in default. That is, the first image forming mode is automatically selected. Since a low gloss key and a high gloss key are prepared in the operating portion, the user can select any one of them about the glossiness of the image.

When image forming is started (S322), whether the glossiness set at S321 is high gloss is judged (S323). If it is judged to be high gloss, the controller 200 switches the fixing flapper 50 to thereby switch the conveying path to 51*a* (S324). On the other hand, if it is judged to be low gloss, the conveying path remains 51*b*. After the preparation of the image forming apparatus has been completed (S326), image forming is started (S312). In the case of high gloss, the conveying path is switched to 51*b* after the completion of the job (S320), thus completing the image forming operation.

Embodiment 2

Embodiment 2 is substantially the same as Embodiment 1 in construction and the image forming operation and therefore, the main differences thereof from Embodiment 1 will hereinafter be described and similar portions will be suitably omitted.

In Embodiment 1 described above, the conveying path is switched by the fixing flapper 50, whereby the switching of whether use should be made of one pair of fixing rollers or two pairs of fixing rollers is performed. The present embodiment, however, has a single conveying path, and has a pair of separable fixing rollers disposed with the conveying path interposed therebetween, and a second and subsequent pairs of fixing rollers may assume a normal state in which they are separated from each other to thereby perform the afore-described switching of the image forming mode.

Specifically, in the present embodiment, the fixing flapper 50 and the conveying path 51*b* are eliminated, and the pair of fixing rollers 32*b* used only in the second image check mode are provided with separating means (not shown) capable of switching the nipping/releasing of the rollers, whereby they are separably disposed with the conveying path interposed therebetween. The controller 200 controls the separating means so as to separate the pair of fixing rollers not in use from each other. Therefore, a plurality of conveying paths are unnecessary, and the downsizing of the apparatus can be achieved.

Also, in Embodiment 1, the supply of electric power to the fixing heaters 213 and 214 is immediately started (S302 shown in FIG. 3), but a consumed electric power reducing key for supplying no electric power to the fixing heater 214 of the pair of fixing rollers 32*b* not used at first in the first image check mode, or for setting the set temperature of the fixing heater 204 to a lower level than during ordinary image forming may be provided in the operating portion so that the user can suitably select it. In that case, it is possible to shorten the time required for the apparatus to rise so that the first image check mode can be carried out, and it is possible to suppress the electric power consumption during standby.

Embodiment 3

Embodiment 3 is substantially the same as Embodiment 1 in construction and the image forming operation and therefore, the main differences thereof from Embodiment 1 will hereinafter be described and similar portions will be suitably omitted.

In Embodiment 1, the selection of whether after the outputting in the first image check mode, shift should be made to the second check mode or the ordinary image forming mode should be started is judged and inputted on the basis of the result of the user having measured the output image by the user's own visual perception or by a measuring apparatus (S310 in FIG. 3), but this may be automated as will be described later.

Specifically, on a conveying path downstream of the pair of fixing rollers 32*b* with respect to a recording material conveying direction, there is provided a detecting sensor 52 for detecting the state of the image (the glossiness of the image) on the recording material on which the toner image has been fixed. In case of the setting of the condition of the image forming job (S306 shown in FIG. 3), glossiness, which is a target, is set through a glossiness input key prepared in the operating portion. Then, after the outputting in the first image check mode has been ended, the glossiness which is one of indices indicative of the state of the image on the outputted recording material S is detected by the detecting sensor 52.

If the detected glossiness is equal to or greater than the value set by the user, the controller 200 controls the image forming apparatus so as to deal with the remaining image forming job under the intact fixing conditions, and when the outputting of all the number of set copies is completed, a series of image forming steps are terminated.

On the other hand, if the detected glossiness is less than the set value, the controller 200 performs the control of the image forming apparatus so as to subsequently enter the second image check mode. That is, the controller 200 is designed to select whether the second image check mode should be executed on the basis of the result of the detecting sensor having detected the state of the image on the recording material on which the toner image formed by the first image check mode has been fixed. In this case, the user looks at or measures by a measuring apparatus the sheet outputted by each of the first and second image check modes, and finally selects whether the job should be intactly started or whether the job should be stopped in order to take a step such as changing the paper.

Also, the state of the image outputted by the execution of the second image check mode is detected by the detecting sensor 52 and if the glossiness of the image is equal to or greater than the value set by the user, the controller 200 may control the image forming apparatus so as to deal with the remaining image forming job under the intact fixing conditions. In this case, the user need not look at or measure the outputted recording material by the measuring apparatus, and it becomes unnecessary for the user to take extra trouble. Also, subsequently to the second image check mode, the operation is automatically switched to the image forming operation for the number of remaining copies and therefore, the time required for the user to judge can be saved, and productivity can be improved.

Also, in preparation for a case where this glossiness detecting sensor 52 gets out of order by any chance, design may be made so as to be capable of selecting an automatic mode for performing glossiness check-up by the use of the glossiness detecting sensor 52, and a mode which does not use this glossiness detecting sensor 52 (such a manual mode as shown in Embodiments 1 and 2 wherein the glossiness check-up is performed by the operator). Of course, such selection by the user is performed through an automatic key and a manual key prepared in the operating portion.

(Modifications)

As described above, each image check mode according to each embodiment is carried out to effect the selection of one or plural fixing means and the setting of the fixing conditions so that the glossiness of the output image may assume a desired value. However, when the amount of heat applied to the recording material is changed by the number of the fixing means used and the fixing conditions, the color taste and density of the output image are also changed. So, the above-described image check modes can be utilized not only to obtain proper glossiness, but also to obtain a proper color taste and proper density. In that case, for example, the user may visually confirm the density and color taste, or an optical sensor for measuring the density and color taste may be provided instead of or in addition to the glossiness detecting sensor.

Also, in each embodiment, description has been made of a case where the number of copies outputted by the image check modes is one. However, among some users, there is a desire to check up all images thoroughly. There is also conceivable a desire to check up not all images, but images corresponding to several pages. On the supposition of such a case, design may be made such that before the start of the image forming job, the number of copies outputted by the execution of the image check modes can be set by the user through a check copy number key prepared in the operating portion.

Also, as in the above-described embodiments, the present invention can equally be applied to a case where provision is made of two fixing means differing in the level of the glossiness of the image after the toner image has been heat-processed, namely, differing in image glossiness treating capability from each other, and only one or the other of these two fixing means is used to heat-process the image and fix the image on the recording material. Specifically, two image check modes are prepared corresponding to two ordinary image forming modes in which the fixing means used differ from each other. In this case, a mode for heat-processing the image by the use of the two fixing means may be further provided as an ordinary image forming mode, and it is preferable that an image check mode be also provided correspondingly to this mode.

Also, while in each embodiment, description has been made on the supposition that the number of the fixing means is two, the number of the fixing means may be three or more. In that case, it is preferable to prepare the image check modes correspondingly to the ordinary image forming modes differing in (the combination of) the fixing means used from one another.

Also, while in each embodiment, description has been made of a case where the fixing means are pairs of fixing rollers, in the present invention, the fixing means can be changed various constructions such as, for example, a combination of a roller and a fixing belt (fixing film), etc. Also, as regards the method of heating the fixing means, there may be adopted a high frequency induction heating method.

As described above, according to each embodiment, an image of a desired quality can be obtained by a simple method. In that case, the user can obtain an output image in an image state desired by himself without a wasteful output being performed due to the error of setting, or the like. Also, an image of a desired quality can be obtained while a reduction in productivity is suppressed. Also, an image of a desired quality can be obtained simply without the user taking extra trouble.

This application claims priority from Japanese Patent Application No. 2005-064231 filed on Mar. 8, 2005, which is hereby incorporated by reference herein.

What is claimed is:

1. An image forming apparatus comprising:

image forming means for forming an image on a recording material;

first and second image heating means for heating the image on the recording material;

executing means, which can execute, prior to an ordinary image formation, a first check mode for checking up an image, which is heated by the first image heating means and is not heated by the second image heating means, and a second check mode for checking up an image, which is heated by the first and second image heating means, wherein the executing means can execute the second check mode after the first check mode is executed;

selecting means for selecting as to whether or not the second check mode is executed after the first check mode is executed by the executing means;

setting means for setting a glossiness of the image on the recording material in the ordinary image formation after the first check mode is executed and after the second check mode is executed; and prompting means for prompting a user, in accordance with the glossiness set by said setting means, to change a type of the recording material on which the image is to be formed.

2. An image forming apparatus according to claim 1, further comprising means for setting as to whether or not the first check mode is executed prior to the ordinary image formation.

* * * * *